US008657157B2

(12) United States Patent
Blinn

(10) Patent No.: US 8,657,157 B2
(45) Date of Patent: Feb. 25, 2014

(54) BOTTLE CLOSURE WITH POUR SPOUT AND RELATED METHODS

(75) Inventor: Edward P. Blinn, Manhattan Beach, CA (US)

(73) Assignee: The Patrón Spirits Company, Las Vegas, NV (US)

( * ) Notice: Subject to any disclaimer, the term of this patent is extended or adjusted under 35 U.S.C. 154(b) by 563 days.

(21) Appl. No.: 12/645,652

(22) Filed: Dec. 23, 2009

(65) Prior Publication Data

US 2011/0147405 A1 Jun. 23, 2011

(51) Int. Cl.
*B67B 7/00* (2006.01)
*B67D 3/00* (2006.01)

(52) U.S. Cl.
USPC ..... 222/1; 222/23; 222/479; 222/482; 222/567

(58) Field of Classification Search
USPC ..... 222/23, 173, 179.5, 476–479, 481, 222/481.5, 482, 488, 489, 500, 544, 545, 222/562, 566, 567, 571; 215/200, 226, 230, 215/316, 355, 250, 252; 220/256.1, 257.1, 220/257.2, 258.1, 258.2, 258.3
See application file for complete search history.

(56) References Cited

U.S. PATENT DOCUMENTS

| | | | | | |
|---|---|---|---|---|---|
| 523,918 | A | | 7/1894 | Palmer | |
| 650,749 | A | * | 5/1900 | Chapman | 215/316 |
| 1,436,708 | A | | 11/1922 | Goebel | |
| 2,096,585 | A | * | 10/1937 | Hoeter | 222/479 |
| 2,164,315 | A | | 7/1939 | Edwards | |
| 2,477,984 | A | * | 8/1949 | Jackson | 222/78 |
| D169,462 | S | | 4/1953 | Voight | |
| D171,388 | S | | 2/1954 | Du Pree et al. | |
| 2,727,644 | A | | 12/1955 | Giannos | |
| 2,790,582 | A | * | 4/1957 | Halpern | 222/481.5 |
| 2,825,495 | A | * | 3/1958 | Fazio | 222/478 |
| 2,991,897 | A | * | 7/1961 | Burnett | 215/21 |
| 3,045,879 | A | * | 7/1962 | Daly | 222/482 |
| 3,061,151 | A | | 10/1962 | Clare | |
| D198,599 | S | | 7/1964 | Koukai | |
| 3,422,998 | A | | 1/1969 | Murray | |
| 3,434,636 | A | * | 3/1969 | Kachman | 222/567 |
| 4,518,094 | A | * | 5/1985 | Kodman | 220/254.3 |
| 4,666,065 | A | * | 5/1987 | Ohren | 222/478 |
| 4,925,068 | A | * | 5/1990 | Schneider | 222/484 |
| 5,072,861 | A | | 12/1991 | Jou | |
| 5,261,176 | A | * | 11/1993 | David et al. | 40/324 |
| 5,799,836 | A | * | 9/1998 | Lee | 222/189.07 |
| 6,012,617 | A | * | 1/2000 | Knight et al. | 222/481.5 |
| 6,230,944 | B1 | | 5/2001 | Castellano et al. | |

(Continued)

OTHER PUBLICATIONS

Photographs of two bottle closures that were on sale more than one year prior to the filing date of the referenced application. The Examiner is invited to contact applicant's attorney should he/she have any questions regarding the photographs.

*Primary Examiner* — Kevin P Shaver
*Assistant Examiner* — Patrick M Buechner
(74) *Attorney, Agent, or Firm* — Jeffer Mangels Butler & Mitchell LLP

(57) ABSTRACT

A method for a bartender's easy selection of an appropriate pour spout for a bottle of interest from one or more pour spouts comprising providing one or more bottles each having an original closure; and providing one or more pour spouts essentially identical in outer shape to its corresponding original closure; wherein the bartender easily identifies the appropriate pour spout due to its similarity in shape to the shape of its corresponding original closure.

10 Claims, 17 Drawing Sheets

(56) References Cited

U.S. PATENT DOCUMENTS

| | | | | |
|---|---|---|---|---|
| 6,742,678 | B1 | 6/2004 | Krystopik, Jr. | |
| 7,806,303 | B1 * | 10/2010 | Hastings | 222/481.5 |
| D643,721 | S * | 8/2011 | Blinn | D9/440 |
| 2003/0211206 | A1 * | 11/2003 | Sharp et al. | 426/115 |
| 2004/0250690 | A1 * | 12/2004 | Restis et al. | 99/403 |
| 2004/0262247 | A1 * | 12/2004 | Moon | 211/74 |
| 2005/0191398 | A1 * | 9/2005 | Duffy et al. | 426/592 |
| 2006/0186081 | A1 * | 8/2006 | Reed et al. | 215/230 |
| 2010/0230447 | A1 * | 9/2010 | Eriksen | 222/481.5 |

* cited by examiner

BOTTLE CLOSURE WITH POUR SPOUT AND RELATED METHODS

FIELD OF THE INVENTION

This invention is directed to a pour spout for a bottle and more particularly to a pour spout that will aid in the quick identification of a bottle, and methods of using the same.

BACKGROUND OF THE INVENTION

Pour spouts are frequently used to pour a beverage of choice from a bottle, such as alcoholic beverages, such as vodka or tequila. Often times, a number of bottles are stored in one location, perhaps at a bar in a home or a restaurant. These bottles may be constructed in all shapes and sizes, depending on the type and/or brand of alcohol stored therein. When one or more bottles are opened and are being made ready for use, a bartender or a person at home will want to insert a pour spout in each bottle to be used. Because each bottle may have different sized openings, it can be difficult to locate the properly sized pour spout for each specific bottle. Additionally, once a pour spout is inserted in the appropriate bottle, and the bottles are placed together, such as in a well at a bar, it can be difficult to distinguish one bottle from the other, if the pour spouts look similar.

SUMMARY OF THE PREFERRED EMBODIMENTS

In accordance with one aspect of the present invention there is provided a method of pouring a beverage from a beverage bottle having an original closure that includes the steps of providing a pour spout; removing the original closure from the bottle; inserting the pour spout into the bottle; and pouring the beverage. The pour spout is essentially identical in outward shape to the original closure but is provided with an air inflow conduit and a beverage outflow conduit. In one aspect of this embodiment, the beverage outflow conduit runs axially from an inside of the beverage bottle and then turns radially to an edge of the pour spout for pouring the beverage. Preferably, the pour spout comprises a top, and indicia disposed on the top. Preferably, the step of pouring the beverage comprises the step of viewing indicia to aid in locating the beverage outflow conduit and pouring the beverage.

In accordance with another aspect of the present invention there is provided a method for a bartender's easy selection of an appropriate pour spout for a bottle of interest from one or more pour spouts comprising providing one or more bottles each having an original closure; and providing one or more pour spouts each essentially identical in outer shape to its corresponding original closure. The bottles may be housed in wells.

In accordance with another aspect of the present invention, a method for easily identifying an appropriate pour spout for a bottle of interest is provided. The method may include the steps of viewing the bottle of interest from one or more bottles, and selecting the appropriate pour spout for the bottle of interest from one or more pour spouts based upon its similarity in shape to an original closure of the bottle of interest. The method may further include the step of inserting the selected pour spout into the bottle of interest and pouring the beverage. The method may further comprise the step of identifying the appropriate original closure for the bottle of interest based upon its similarity in shape to the selected pour spout.

In accordance with another aspect of the present invention, a method of quickly and easily pouring drinks at a bar is provided. The method includes the steps of providing one or more bottles each having an original closure; selecting a bottle; removing the original closure from the selected bottle; identifying the appropriate pour spout for the selected bottle based upon its similarity in shape to the original closure of the selected bottle; and pouring the beverage from the selected bottle. In one aspect of the present invention, the method further comprises the step of removing the pour spout from the selected bottle and inserting the original closure back into the selected bottle, wherein the appropriate original closure is identified based upon its similarity in shape to the pour spout of the selected bottle.

In accordance with another aspect of the present invention, a kit is provided. The kit may include at least one bottle; at least one original closure adapted for insertion into the bottle; and at least one pour spout essentially identical in outer shape to the original closure. The bottle may hold alcohol, such as tequila, vodka, rum, or the like.

In accordance with another aspect of the present invention, a kit is provided. The kit may include one or more bottles; and one or more matching pairs of original closures and pour spouts.

In accordance with another aspect of the present invention, there is provided a pour spout that is essentially identical in outward shape to its corresponding original closure. The pour spout may include an outer protruded portion including first and second conduits. The second conduit may be adapted for liquid outflow and first conduit is adapted for air inflow. The second conduit may be at about a ninety degree angle to a longitudinal axis of the bottle. The pour spout may include a second portion, contiguous with the outer protruded portion, for insertion into the neck of a bottle. In one aspect of this embodiment, neither the first nor the second conduits protrude from the outer protruded portion. Preferably, the pour spout includes a top and a bottom, and the top is flat.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which:

FIGS. 11*a* and 1*b* are front elevational views of an original stopper and a pour spout, respectively, in accordance with another preferred embodiment of the invention.

Like numerals refer to like parts throughout the several views of the drawings.

DETAILED DESCRIPTION

As shown in FIGS. 1*a*-18, the present invention is directed to a pour spout essentially identical in outward shape to the original closure of a bottle, generally indicated as 10, and methods of using the same.

It will be appreciated that terms such as "front," "back," "top," "bottom," "left," "right," "above," and "side" used herein are merely for ease of description and refer to the orientation of the components as shown in the figures. It should be understood that any orientation of the components described herein is within the scope of the present invention.

Referring now to FIGS. 1*a*-11*b*, the present invention is directed to a pour spout and methods of using thereof.

Figure 1B:
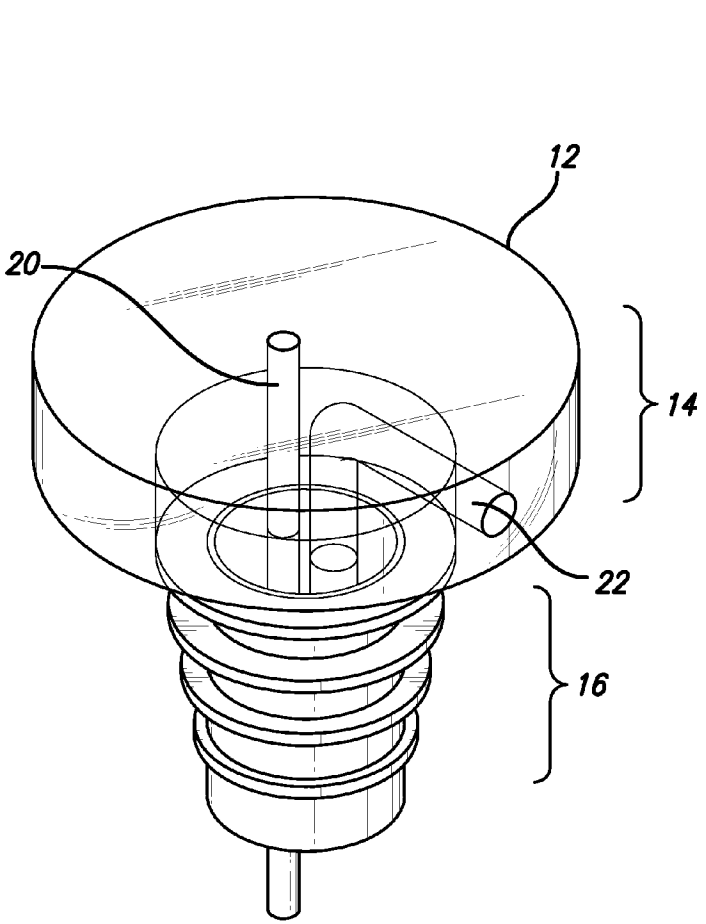
FIGS. 1*a* and 1*b* are front elevational views of an original closure and of a pour spout, respectively, in accordance with a preferred embodiment of the present invention.
Figure 1A:
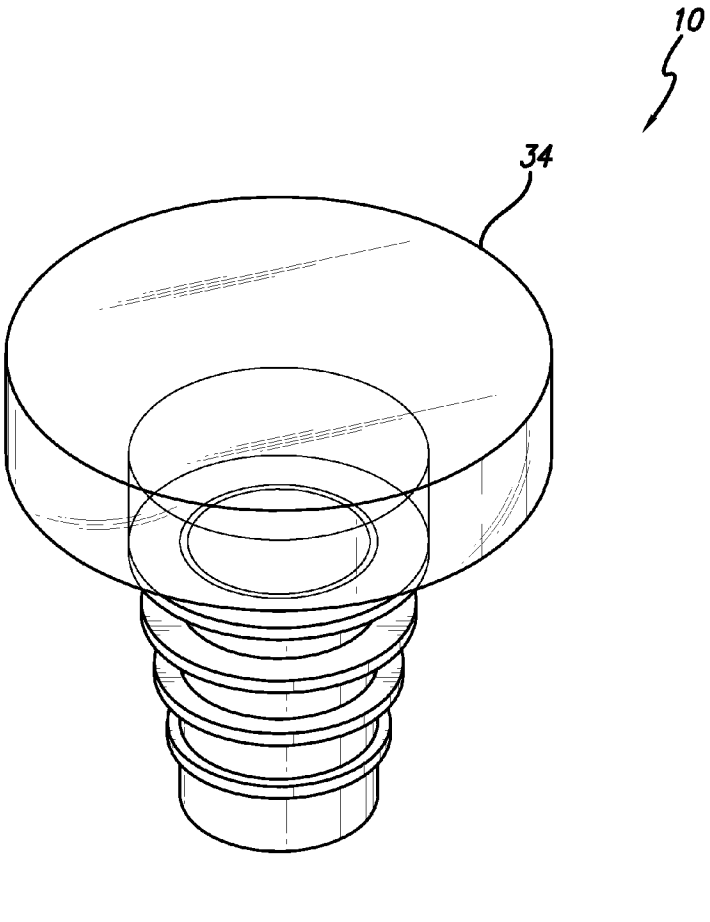

In a preferred embodiment, and as best seen in FIGS. 1*a*-*b*, the present invention is generally directed to a pour spout 12 that is essentially identical in outward shape to the shape of the original closure 34 of the bottle. Preferably, and as used herein, "shape" does not include texture, color scheme, color, material, or the like. As used herein, "essentially identical in outward shape" or "essentially identical in outer shape" may refer to a comparison of the shape of each of the original closure and the pour spout when each is received in a bottle, or when one is received in the bottle, and the other is not, and/or may refer to a comparison of the shapes of each of the original closure and the pour spout when both are outside of the bottle and/or when both are above the lip of the bottle. As such, it follows that, as used herein, "essentially identical in outward shape" or "essentially identical in outer shape" refers to a comparison of the shape of each of the original closure and the pour spout irrespective of texture, color scheme, color, material composition, or the like. As used herein, "bartender" may refer to any individual pouring drinks, whether at a bar, home, restaurant, or other location. As used herein, "pour spout" may refer to any structure that forms an airtight, or substantially airtight, seal with a neck of a bottle and is adapted for pouring a beverage from the bottle. The pour spout may be any shape or size depending on the particular bottle that it is designed to fit. As used herein, "original closure" may refer to the stopper, cork, plug or other structure that closes a bottle as sold.

In a preferred embodiment, the original closure 34 and the pour spout 12 have the same or similar color scheme, translucency, or the like. In addition, the original closure 34 and the pour spout 12 may be comprised of same or similar materials. As such, each may have the same or similar textures. In yet other embodiments, the original closure 34 and the pour spout 12 may have different color schemes, translucencies, and/or compositions.

Figure 9:
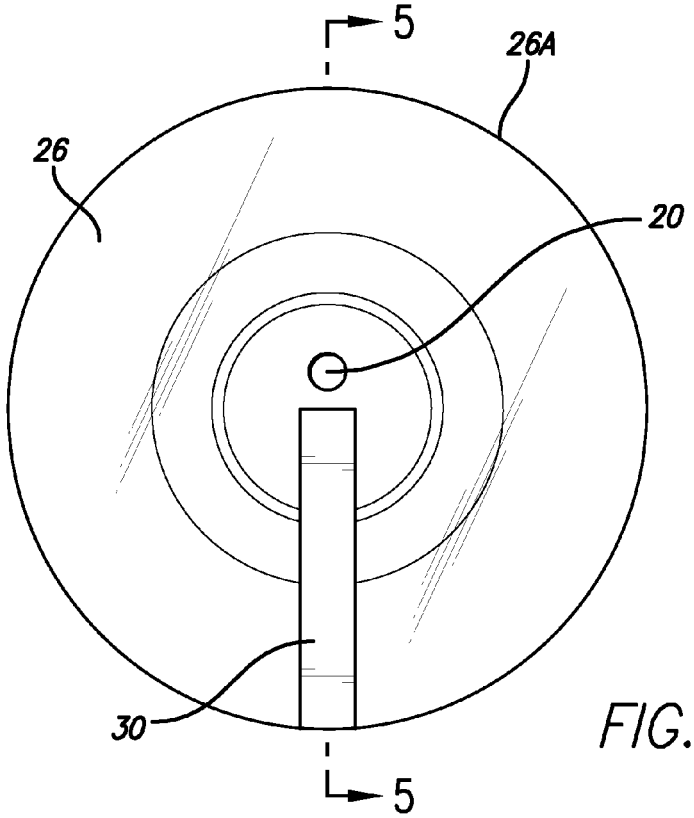
FIG. 9 is a top plan view of the pour spout of FIG. 1*b;*
Figure 10:
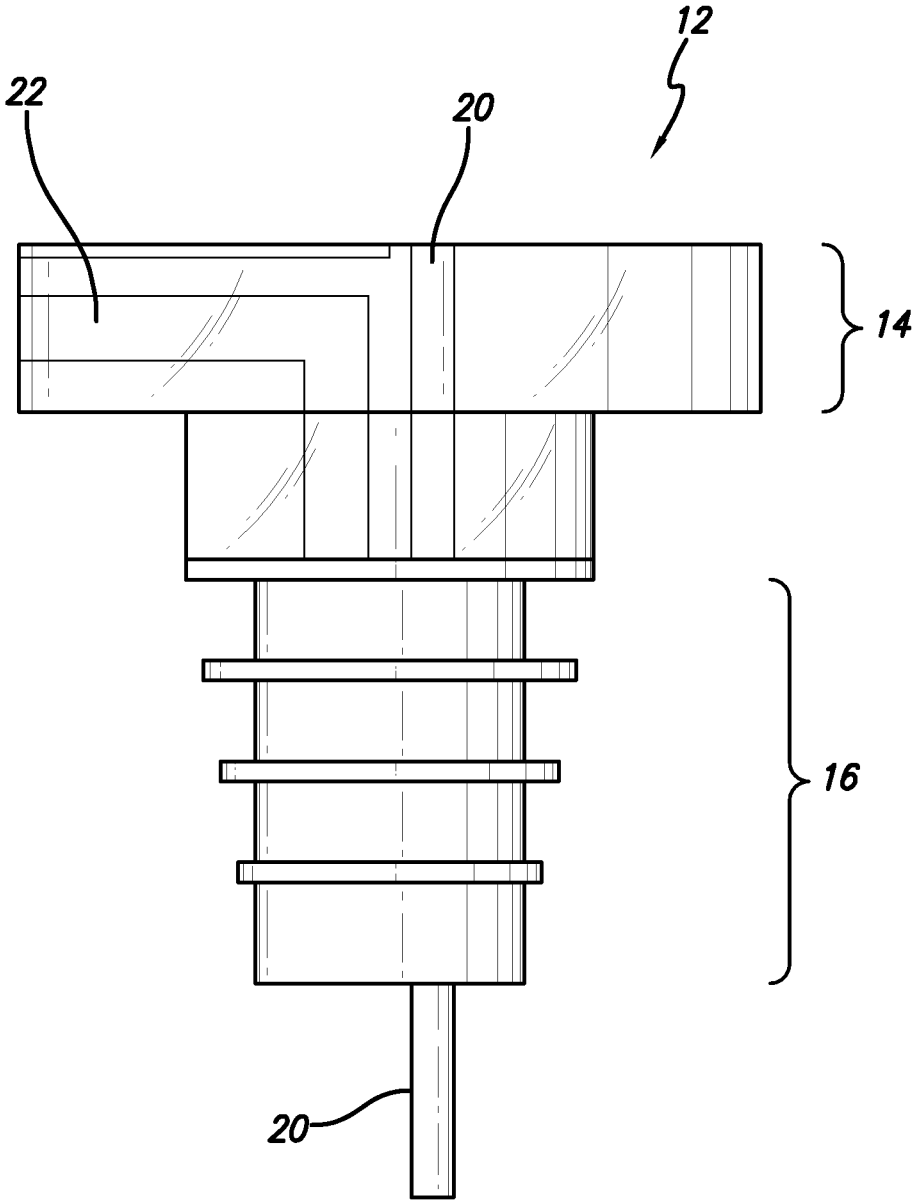
FIG. 10 is a side elevational view of the pour spout of FIG. 1*b;*

In a preferred embodiment, and as best seen in FIGS. 3-7 and FIG. 10, the pour spout 12 comprises a first portion 14 (also referred to herein as "outer protruded portion") and a second portion 16 (also referred to herein as "stopper portion") engaged or attached to each other. Preferably, and as best seen in FIG. 9, a top surface 26*a* of top portion 26 of the pour spout 12 is flat. In other embodiments, top portion 26 of pour spout 12 may be substantially flat or may not be flat. In yet other embodiments, first portion 14 and second portion 16 may be attached to each other in another suitable fashion, or may be not be separate from each other, i.e., may be one unit.

Figure 2:
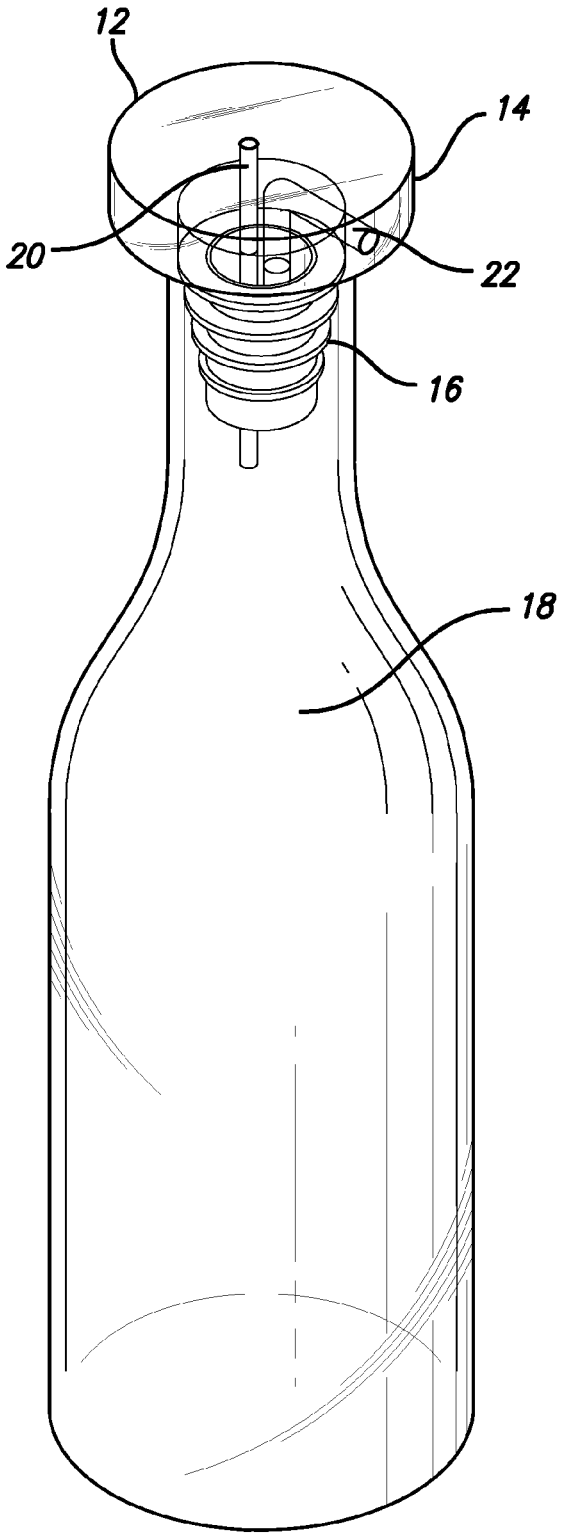
FIG. 2 is a front elevational view of the pour spout of FIG. 1*b* received in a bottle.
Figure 3:
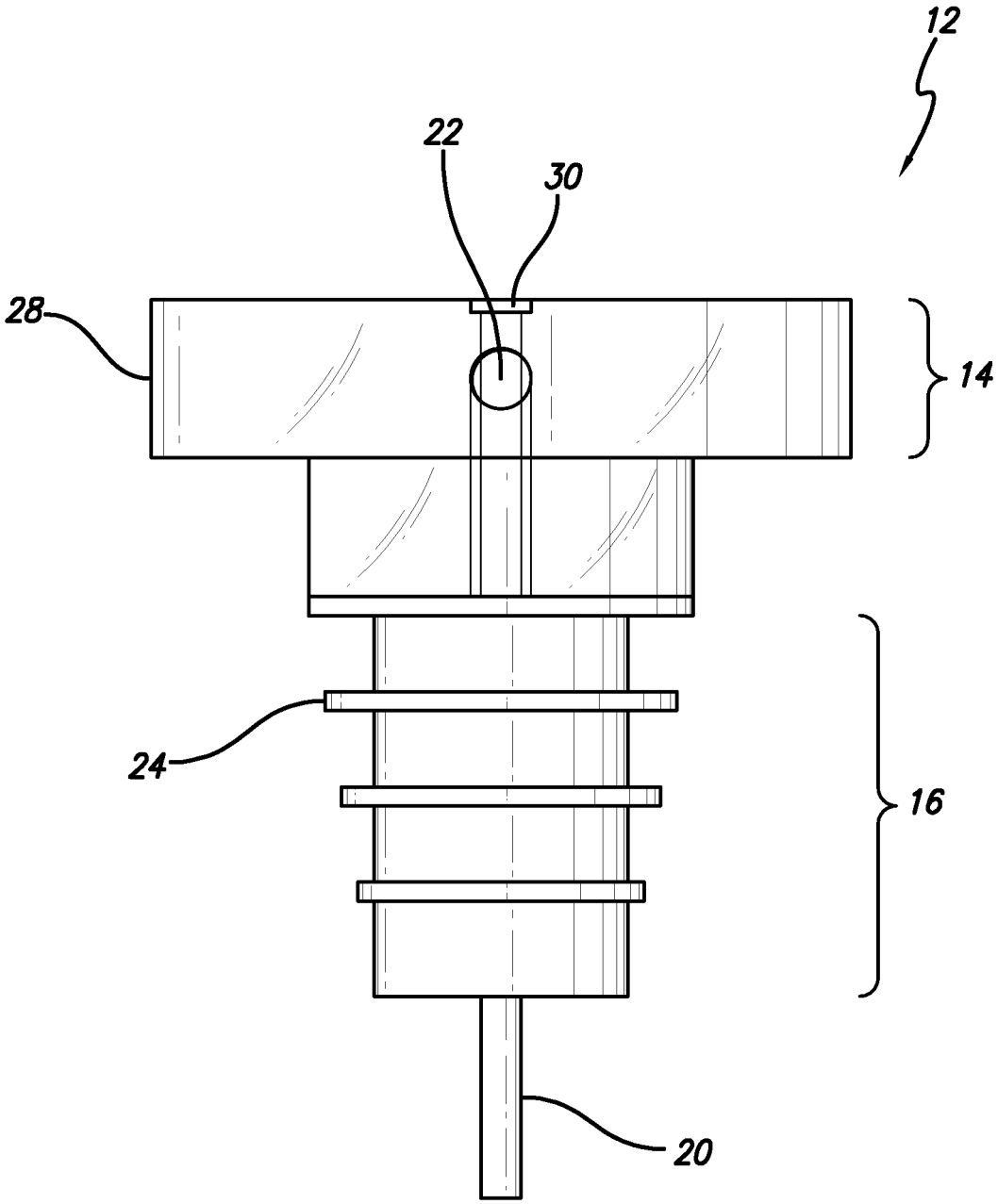
FIG. 3 is a front elevational view of the pour spout of FIG. 1*b;*
Figure 4:
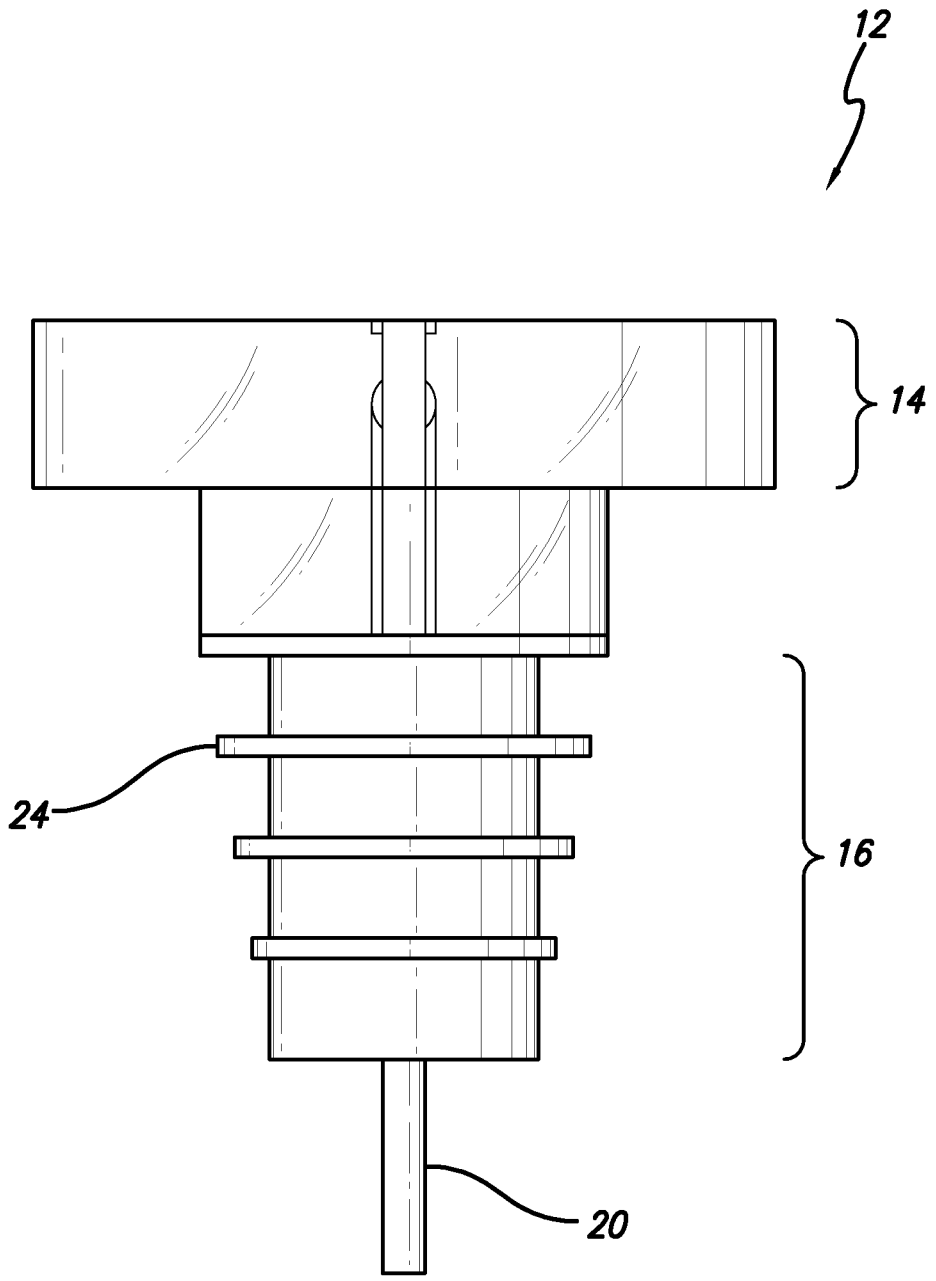
FIG. 4 is a back elevational view of pour spout of FIG. 1*b;*
Figure 5:
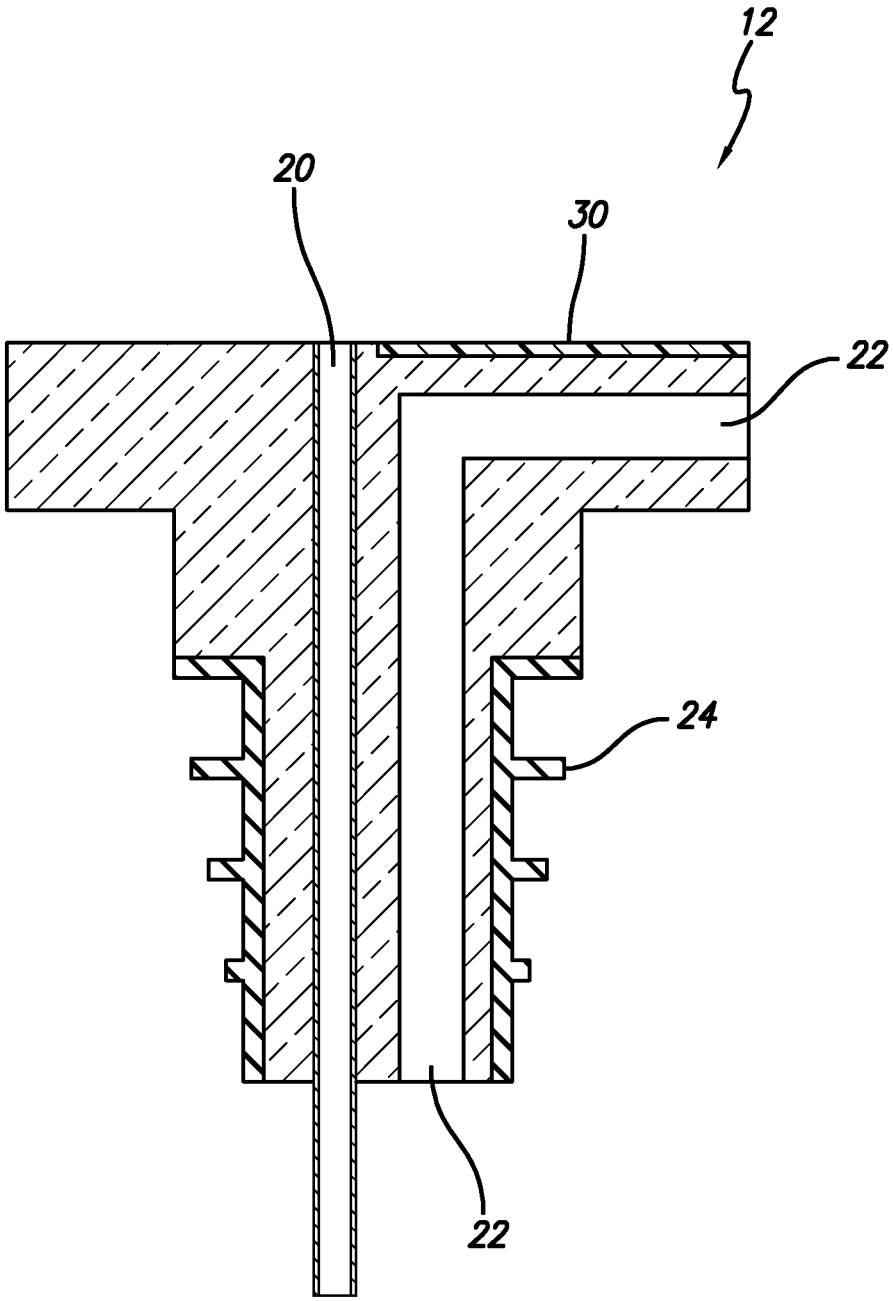
FIG. 5 is a cross-sectional view taken along line 5-5 of the pour spout of FIG. 9.

Preferably, and as best seen in FIG. 2, first portion 14 of pour spout 12 protrudes from a bottle 18 when received in the bottle 18, and houses first conduit 20 and second conduit 22. In a preferred embodiment, first conduit 20 is adapted for the inflow of air, and second conduit 22 is adapted for the outflow of liquid (as used herein, first conduit may be referred to as "air inflow conduit" and second conduit may be referred to as "beverage outflow conduit").

Preferably, and as seen in FIGS. 3-7, second portion 16 is adapted for insertion into bottle 18 and comprises ribs 24 for contacting and sealing bottle 18. In other embodiments, the second portion 16 may include other types of engagement members and/or other means of forming an airtight seal, or substantially airtight seal, between the pour spout and the bottle.

Figure 6:
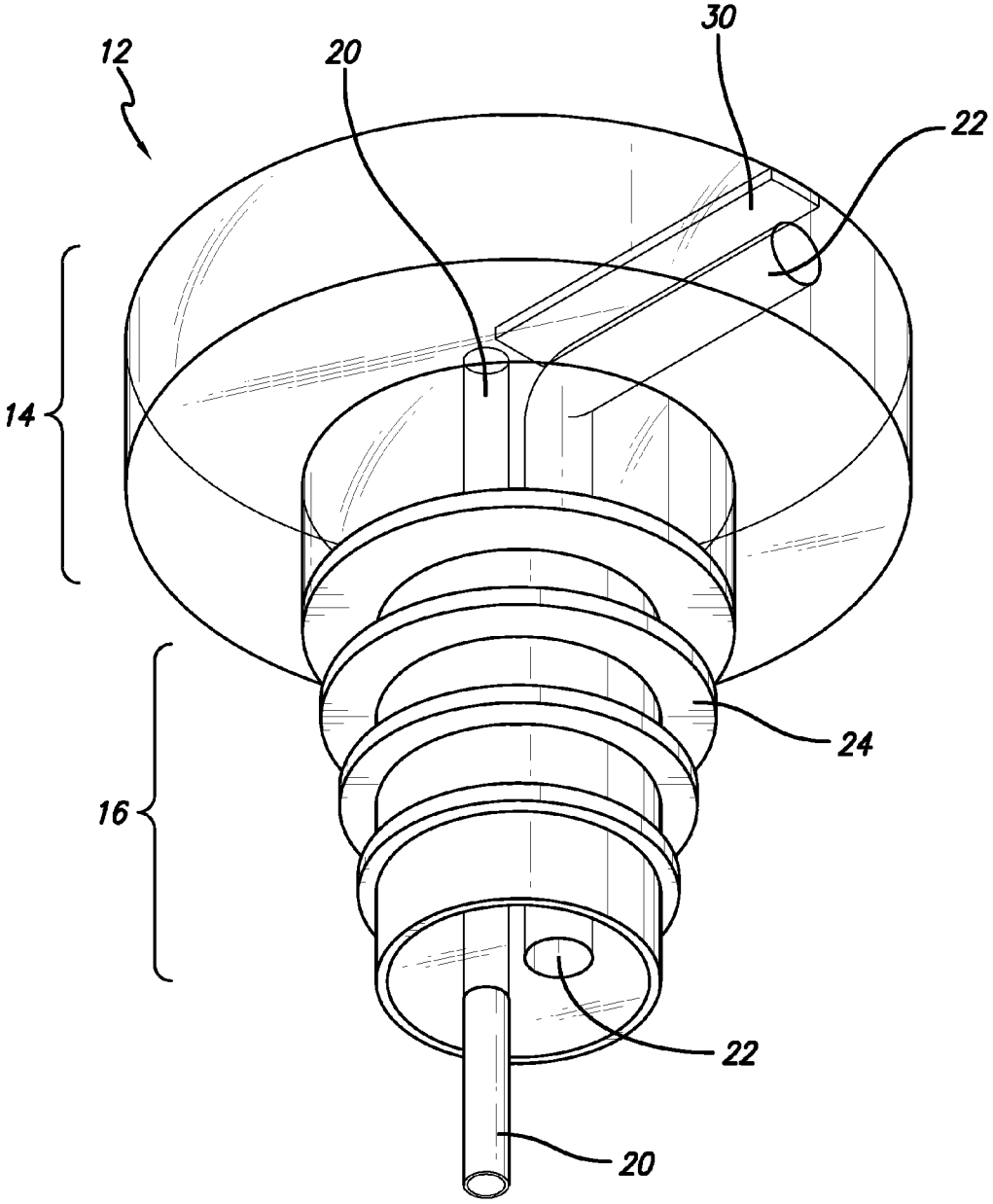
FIG. 6 is a bottom perspective view of the pour spout of FIG. 1*b;*
Figure 7:
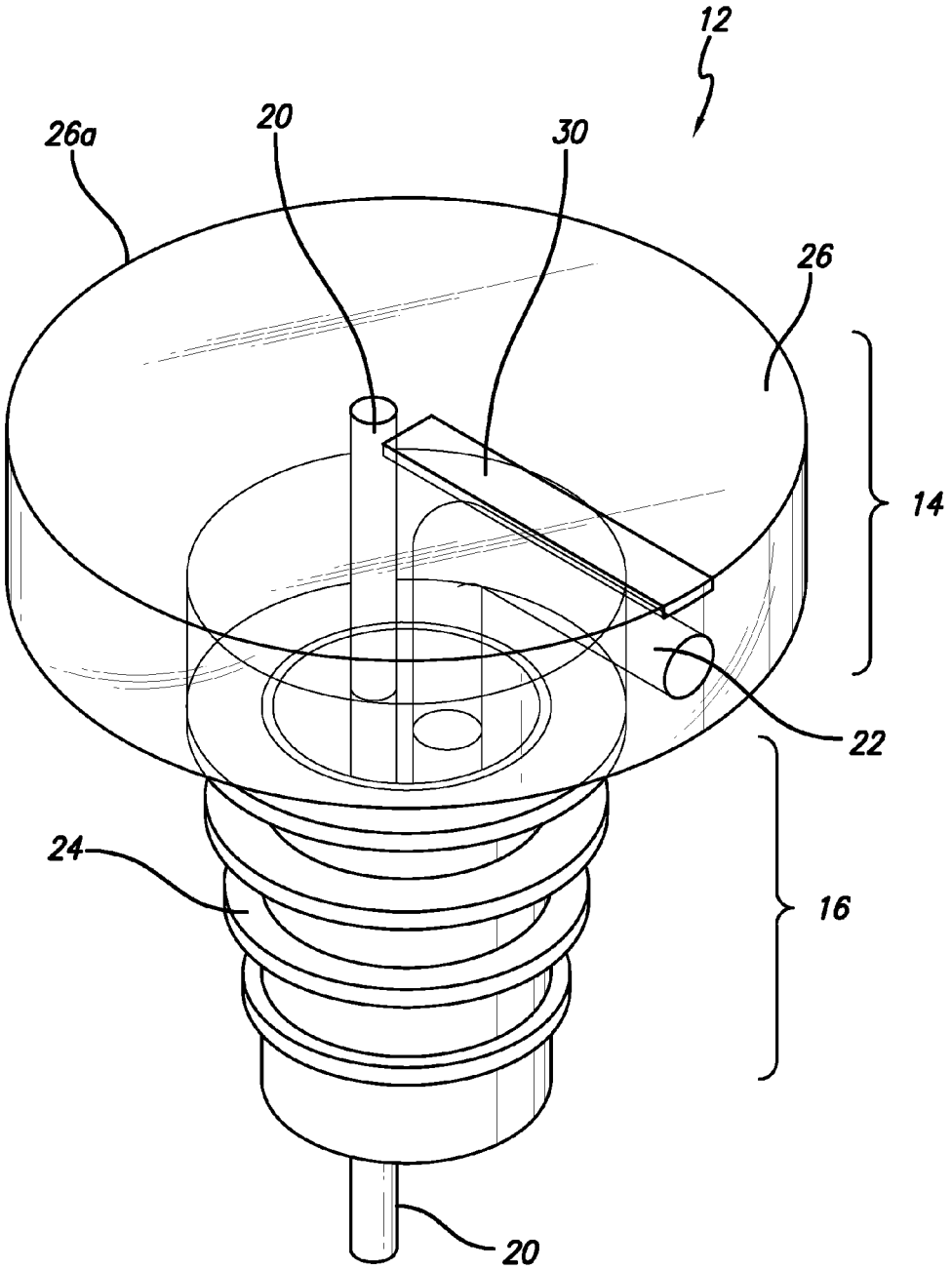
FIG. 7 is a top perspective view of the pour spout of FIG. 1*b;*
Figure 8:
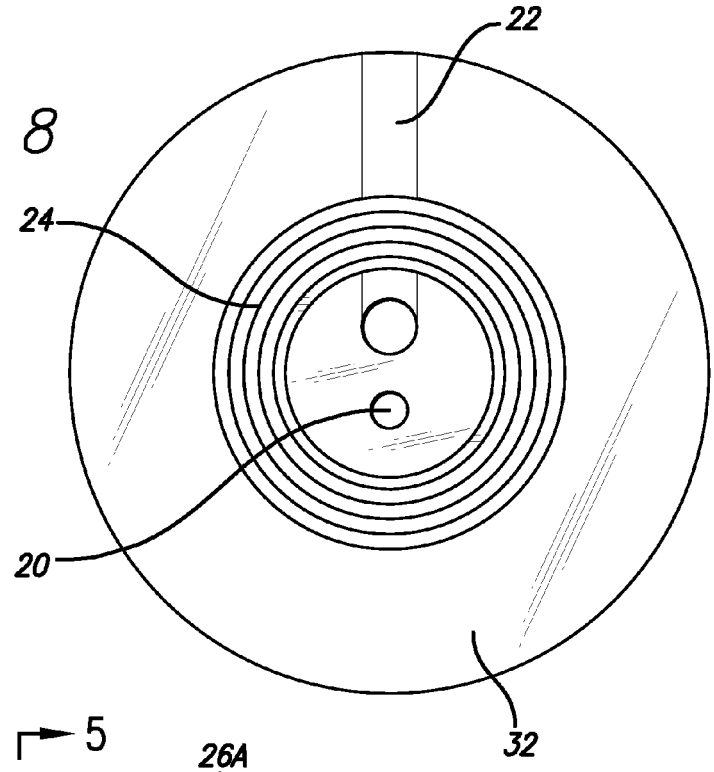
FIG. 8 is a bottom plan view of the pour spout of FIG. 1*b;*

In a preferred embodiment, and as best seen in FIGS. 6 and 7, the first conduit 20 protrudes from the second portion 16 into the bottle 18. Preferably, the first conduit 20 is situated relative to second conduit 22 such that when the bottle 18 is tipped to pour a beverage, the beverage does not seep into the first conduit 20. In this regard, the first conduit 20 may be in a position above second conduit 22 when the bottle 18 is in the horizontal pouring position. Preferably, the first conduit 20 runs axially through the first portion 14 and the second portion 16 of pour spout 12, and second conduit 22 runs axially through pour spout 12, but radially turns at about a ninety degree angle to an edge of pour spout 12. In other embodiments, the first conduit 20 and the second conduit 22 are situated relative to each other such that when the bottle is tipped horizontally to pour the beverage from the pour spout, the beverage does not seep into the air inflow conduit.

In a preferred embodiment, and referring to FIGS. 3-10, first conduit 20 does not protrude from a top 26 of pour spout 12; however, it does protrude from a bottom 32 of second portion 16. Preferably, second conduit 22 does not protrude from a side 28 of pour spout 12, nor does it protrude from bottom 32 of second portion 16. In other embodiments, the first 20 and/or second 22 conduits may be arranged in any fashion, and may or may not protrude from the pour spout in any configuration that allows for the pour spout to have essentially identical outward shape as the shape of the original closure of the bottle.

In a preferred embodiment, and referring to FIG. 2, the liquid in the bottle 18 is alcohol, such as vodka, gin, rum, tequila, cognac, or the like. In other embodiments, the liquid may be any other type of beverage, or any other consumable or non-consumable liquid.

In a preferred embodiment, the first portion 14 of pour spout 12 is clear and transparent, while second portion 16 of pour spout 12 is not clear and transparent, but is rather solid.

In other embodiments, however, second portion 16 may not be solid and/or first portion 14 may not be clear and transparent.

In a preferred embodiment, and referring to FIG. 7, indicia 30 is disposed on top 26 or top surface 26*a* of pour spout 12 at a location above second conduit 22 such that it aids the person in determining the location of the second conduit 22 within the pour spout 12. As used herein, "indicia" is any marking, such as words, letters, arrows, drawings, combinations of the foregoing, and/or the like, to indicate the location of the beverage outflow conduit. In this regard, indicia 30 preferably aids the person in properly rotating the bottle 18 with respect to the glass so that when the beverage is poured out, it falls into the glass. As such, indicia 30 allows the person pouring the beverage to determine which part of the bottle 18 or pour spout 12 to tip downwards in order to pour the beverage from the pour spout 12 and into the glass. In a highly preferred embodiment, indicia 30 is a strip that is disposed on the pour spout 12 in a manner such that is parallel or substantially parallel to a portion of the second conduit 22. In other embodiments, any suitable marker or indicia configured to visually aid a person in pouring liquid from the pour spout may be used. In yet other embodiments, indicia may be formed from the top surface 26*a* of the pour spout 12. In yet other embodiments, pour spout 12 may not include indicia 30.

Figure 11B:
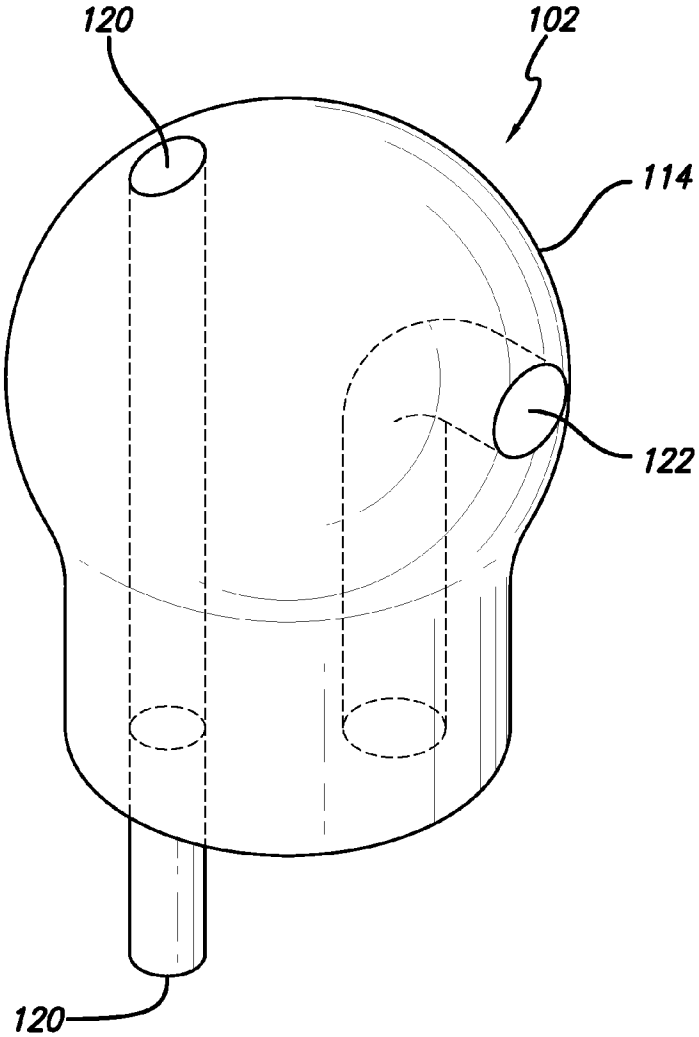
Figure 11A:
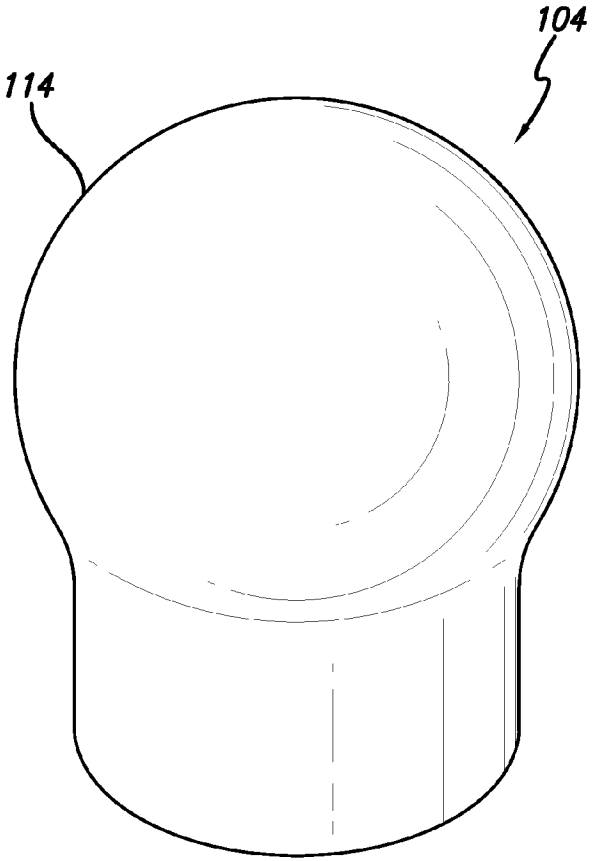
Figure 12:
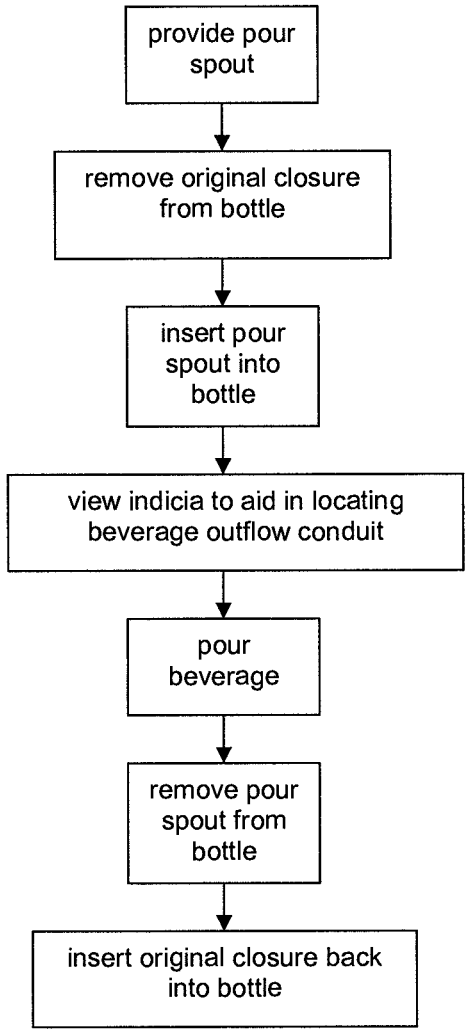
FIG. 12 is a flow chart showing a method of pouring a beverage from a beverage bottle.
Figure 13:
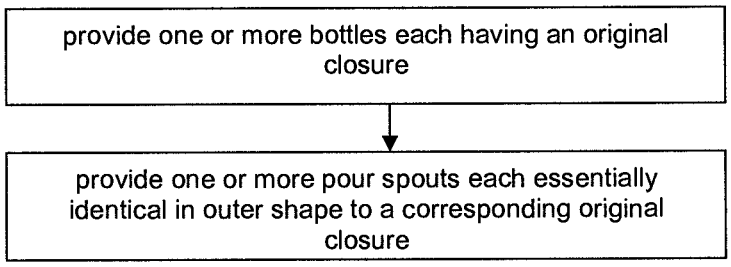
FIG. 13 is a flow chart showing a method for selecting an appropriate pour spout.
Figure 14:
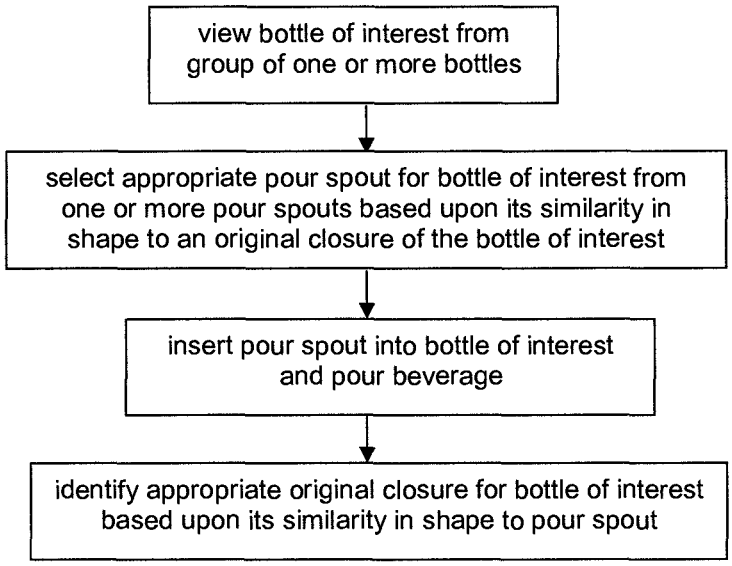
FIG. 14 is a flow chart showing a method of identifying an appropriate pour spout.
Figure 15:
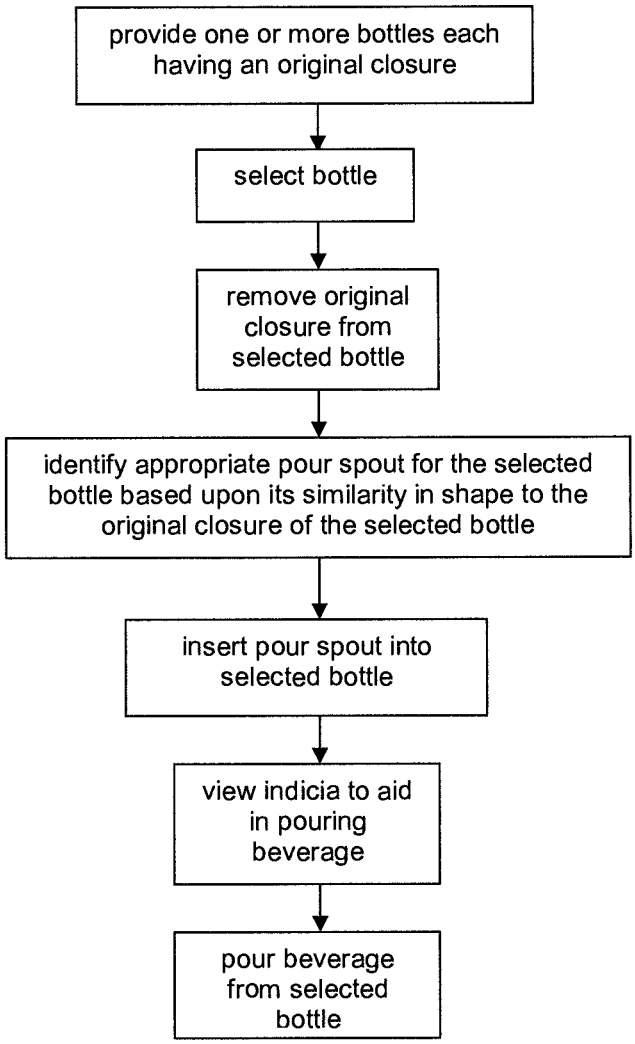
FIG. 15 is a flow chart showing a method for pouring drinks at a bar.
Figure 16:
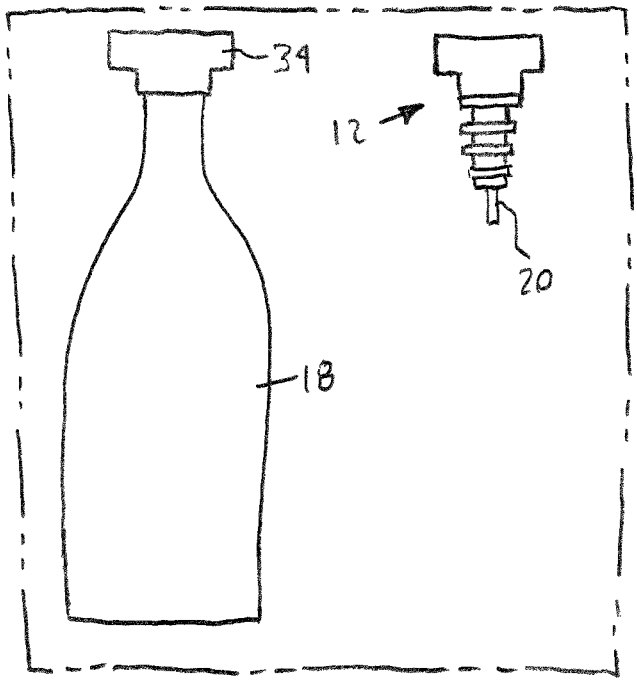
FIG. 16 is a side elevational view of a kit that includes a bottle with an original enclosure and a pour spout.
Figure 17:
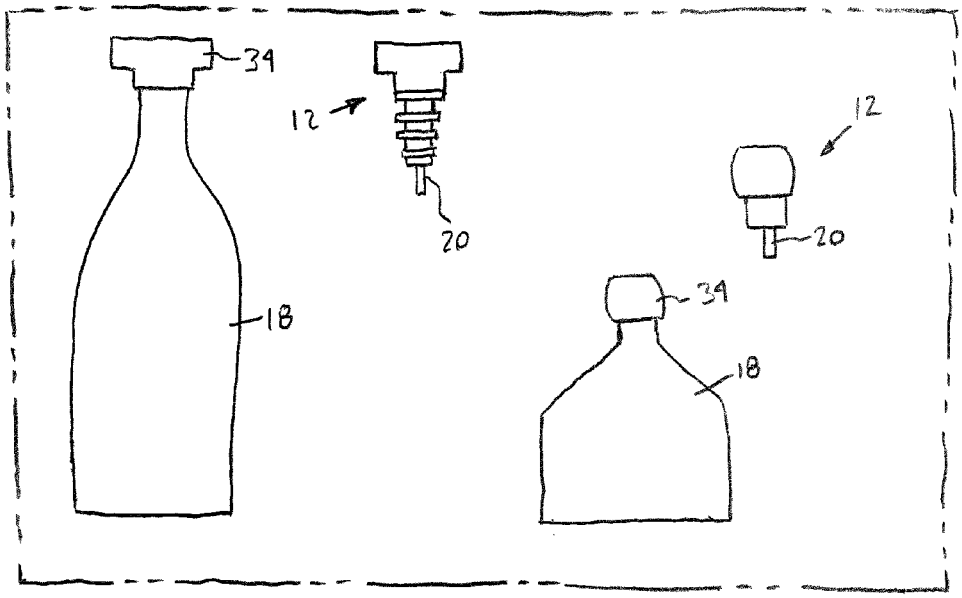
FIG. 17 is a side elevational view of a kit that includes two bottles with original enclosures and corresponding pour spouts.
Figure 18:
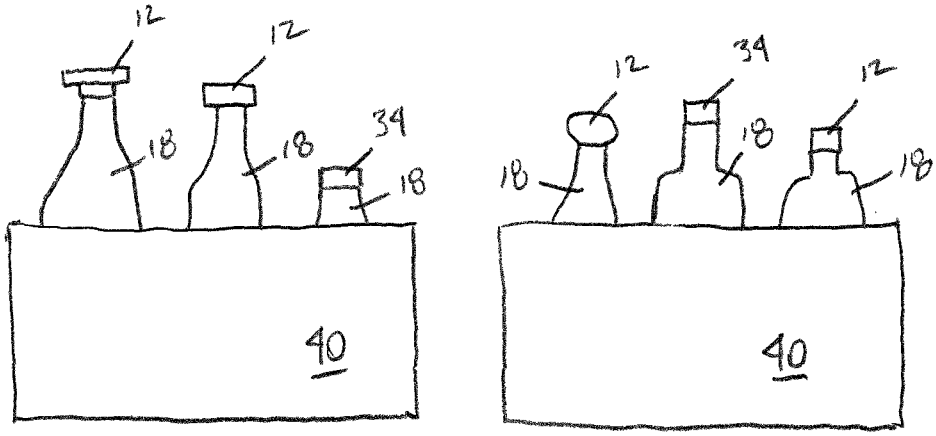
FIG. 18 is a side elevational view of two wells with bottles therein.

In another preferred embodiment, and referring to FIGS. 11*a-b*, the invention is generally directed to a pour spout 102 that is essentially identical in outward shape to an original closure of the bottle, and the original closure of the bottle is a cork 104. Preferably, pour spout 102 includes a first portion 114.

In a preferred embodiment, pour spout 102 includes first conduit 120 and second conduit 122. First conduit 120 is adapted for the inflow of air, and second conduit 122 is adapted for the outflow of liquid. Preferably, neither first conduit 120 nor second conduit 122 conduits protrude from the first portion 114. Preferably, pour spout 102 includes indicia (not shown) to aid in pouring the beverage from the pour spout 102 and into a glass. In other embodiments, pour spout 102 may not include indicia.

In a preferred embodiment, a kit is provided. The kit preferably includes one or more matching pairs of pour spouts and original closures. As used herein, "matching pair(s)" may refer to one or more original closures and one or more corresponding pour spouts essentially identical in outer shape to its corresponding original closure. Preferably, the kit includes at least one bottle having alcohol or the like. In other embodiments, the kit may not include bottle, and the matching pairs may be sold separately.

Many brands of beverages are recognized by their original closure. The similarity of the pour spout to the original closure of the bottle allows for quick and easy identification of the appropriate pour spout to use with the bottle, having, for example, the alcohol of interest and when many different drinks need to be poured at, for example, a bar, in a short period of time, where bottles are frequently placed in "wells" 40 where only the top of the bottle can be seen by the bartender, it is then useful, when possible, to use a pour spout which can be recognized by simply viewing the original closure of the bottle.

For example, the appropriate pour spout for a particular bottle may easily be located simply by observing the shape of the original closure, and comparing it to the shape of the available pour spouts. This allows for easy selection of the appropriate pour spout and then easy drink pouring, especially when the person pouring the drinks is located in a dark environment. The ease of identification of the appropriate pour spout is increased if the color scheme, material composition, and the like of each of the original closure and the pour spout is essentially identical. In this way, the appropriate pour spout from those available may be selected easily. In a like manner, the appropriate original closure for a particular bottle may easily be located simply by observing the shape of the pour spout already inserted in the bottle, and comparing it to the shape of available original closures.

In addition, the angular construction of the second conduit with respect to the first conduit allows for efficient, spill-free pouring of the beverage of choice. For example, since a portion of second conduit is essentially at a ninety degree angle to the longitudinal axis of the bottle, liquid is more easily poured out, as the bottle itself does not need to be tipped all the way horizontally to pour the beverage.

The following examples are presented to enable those skilled in the art to understand and practice the invention and to identify the presently preferred embodiments thereof. This example is provided for illustrative purposes and not to indicate the scope of the invention which is defined only by the appended claims.

EXAMPLE 1

At a bar, a variety of different types of alcohol are available. Each type of alcohol is housed in differently shaped bottles. For example, the size, such as the diameter, of a mouth of one bottle is different from the diameter of the mouth of another bottle. In addition, the appearance of the mouth of one bottle is different from the appearance of the mouth of another bottle. These bottles are placed on a shelf or other structure for easy access. Many bar patrons are eagerly awaiting their drinks. The bartender serving the drinks must act fast. One of the bar patrons requests a vodka drink. The bartender, removes the original closure of a bottle of vodka. Since the appropriate pour spout has essentially the same outward shape as the outward shape of the original closure of the bottle of vodka, the bartender is immediately able to determine which pour spout to use on that particular bottle of vodka.

The bartender then inserts the pour spout into the bottle of vodka, tips the bottle slightly to pour the beverage, and then puts the bottle down. The pour spout is removed, and the original closure is easily identified, as it has essentially the same outward shape as the outward shape of the pour spout. The bartender inserts the original closure back into the bottle, so the beverage will not spill if the bottle is tipped over. The bartender is quickly able to serve the next anxious customer.

EXAMPLE 2

At a bar, a variety of different types of alcohol are available. Each type of alcohol is housed in a bottle of varying dimensions and appearance. For example, the size, such as the diameter, of a mouth of one bottle is different from the diameter of the mouth of another bottle. Each of these bottles is stored in a well at the bar. Each well is of sufficient depth to hold each bottle securely in place. For example, the depth of the well may almost be equal to the height of the bottle. As such, only the pour spout of each bottle may be seen by an individual, such as a bartender, when the bottle is housed in the well. The pour spout of each bottle is essentially identical in outer shape to the shape of the corresponding original closure of the bottle. A bar patron requests a tequila drink. Since the appropriate pour spout has essentially the same outward shape as the shape of the original closure of the bottle of tequila, the bartender is immediately able to determine which bottle is the bottle of tequila requested simply by remembering the shape of the original closure of the bottle of tequila.

The bartender then tips the bottle slightly to pour the tequila, and then puts the bottle down into the well. The bartender quickly serves another bar patron in a similar fashion.

At the end of the night, the pour spout of each bottle is removed, and the original closure that corresponds with each bottle is easily identified, as it has essentially the same outward shape as its pour spout. The bartender inserts the original closure back into the bottle, so the beverage will not spill if the bottle is tipped over.

While certain embodiments of the invention have been described, these embodiments have been presented by way of example only, and are not intended to limit the scope of the inventions. Indeed, the novel methods and elements described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A method of pouring a beverage from a beverage bottle having an original closure comprising:

(a) obtaining a pour spout;

(b) removing the original closure from the bottle;

(c) inserting the pour spout into the bottle; and (d) pouring the beverage;

wherein the original closure has an outer shape, wherein the pour spout has an outer shape that is identical in outer shape to the outer shape of the original closure, wherein the pour spout is provided with a beverage outflow conduit for pouring the beverage, and wherein the beverage can be poured when the outer shape of the pour spout is identical to the outer shape of the original closure.

2. The method of claim 1, wherein the beverage outflow conduit extends in a direction that is substantially parallel to a center axis of the beverage bottle and then extends radially to an edge of the pour spout for pouring the beverage.

3. The method of claim 1, wherein the pour spout comprises a top surface that includes alignment indicia disposed thereon, wherein the alignment indicia is substantially parallel to the portion of the beverage outflow conduit that extends radially.

4. The method of claim 1, further comprising the steps of removing the pour spout from the bottle after step (d) and inserting the original closure back into the bottle.

5. The method of claim 1 wherein the original closure comprises a color scheme, wherein the pour spout comprises an identical color scheme to the original closure.

6. The method of claim 2 wherein the pour spout includes an air inflow conduit that extends in a direction that is substantially parallel to a center axis of the bottle.

7. A kit comprising:

(a) a first bottle;

(b) a first original closure adapted for insertion into the bottle, wherein the first original closure has a first original closure outer shape; and (c) a first pour spout, wherein the first pour spout has a first pour spout outer shape, and wherein the first pour spout outer shape is identical in shape to the first original closure outer shape.

8. The kit of claim 7 wherein the first pour spout includes a beverage outflow conduit and alignment indicia thereon, wherein the alignment indicia is substantially parallel to a portion of the beverage outflow conduit.

9. The kit of claim 7 wherein the first original closure has a first original closure color scheme and the first pour spout has a first pour spout color scheme, and wherein the first pour spout color scheme is identical to the first original closure color scheme.

10. The kit of claim 7 further comprising a second bottle, a second original closure adapted for insertion into the bottle, wherein the second original closure has a second original closure outer shape, and a second pour spout, wherein the second pour spout has a second pour spout outer shape, and wherein the second pour spout outer shape is identical in shape to the second original closure outer shape, wherein the first original closure outer shape is different than the second original closure outer shape.

* * * * *